United States Patent [19]

Jünemann

[11] Patent Number: 4,691,651

[45] Date of Patent: Sep. 8, 1987

[54] TILTABLE SEWING HEAD AND UNDERARM FOR A SEWING MACHINE USED IN CONJUNCTION WITH A WORKPIECE SUPPORTING CARRIER PLATE

[75] Inventor: Hubert Jünemann, Bielefeld, Fed. Rep. of Germany

[73] Assignee: Kochs Adler AG, Fed. Rep. of Germany

[21] Appl. No.: 865,049

[22] Filed: May 20, 1986

[30] Foreign Application Priority Data

May 23, 1985 [DE] Fed. Rep. of Germany ..... 3518474

[51] Int. Cl.[4] ..... D05B 75/00; D05B 39/00

[52] U.S. Cl. ..... 112/259; 112/260; 112/121.14

[58] Field of Search ..... 112/260, 258, 259, 121.14, 112/121.15, 217.1

[56] References Cited

U.S. PATENT DOCUMENTS

| | | | |
|---|---|---|---|
| 361,426 | 4/1887 | Looker | 112/258 |
| 3,513,795 | 5/1970 | Hagemeyer | 112/260 |
| 3,799,089 | 3/1974 | Tolle | 112/258 X |
| 3,847,101 | 11/1974 | Tolle | 112/260 X |
| 4,520,744 | 6/1985 | Portilla | 112/260 |

*Primary Examiner*—Peter Nerbun

*Attorney, Agent, or Firm*—Laff, Whitesel, Conte & Saret

[57] ABSTRACT

In order to overcome especially large areas of obstacle between a carrier plate for a workpiece to be sewn and a tubular stud arranged at the underarm of a sewing head, the underarm is tiltably arranged as to be swung downwards from its working position. The axle about which the tilting of the underarm is carried out, is located in the area of the standard of the sewing head. Additionally the upper arm of the sewing head can be tilted upwards about the same axle. Separate individual tilt drives are provided for the underarm and the upper arm.

12 Claims, 7 Drawing Figures

TILTABLE SEWING HEAD AND UNDERARM FOR A SEWING MACHINE USED IN CONJUNCTION WITH A WORKPIECE SUPPORTING CARRIER PLATE

FIELD OF THE INVENTION

The present invention relates to a sewing head for a sewing machine, in particular with a supporting device for said sewing head and with a carrier for a workpiece to be stitched, wherein the sewing head and the carrier are arranged displaceably relative to each other. In particular, the sewing head is equipped with a standard, an arm and an underarm and a device for removing a tubular stud arranged at said underarm out of an area of obstacle when said sewing head is moved relatively with respect to the carrier of the workpiece.

BACKGROUND OF THE INVENTION

U.S. Pat. No. 3,513,795 discloses a sewing head of the aforementioned type, the underarm of which carries a tubular stud arranged tiltably about an axis in the underarm, so that the tubular stud can be submersed into the underarm. Thus, it is possible to swing out a workholder, i.e. a carrier for a workpiece to be sewn out of the area of stitch formation. With this embodiment areas of obstacle of a thickness of only some millimeters (approximately up to 5 mm) as seen from the direction of the needle can be overbridged. At thicker obstacles it would be necessary to extend the size of the tubular stud, which would lead to difficulties at the actual process of stitch formation.

U.S. Pat. No. 361,426 discloses a sewing machine having an arm tiltable about an axis, in which the axis of the armshaft and the axis of a drive shaft pivoted in a standard cross each other. Moreover, the armshaft and the drive shaft are operably connected by bevel gears. Due to this development a construction is achieved, which is extraordinarily sensitive against tolerances.

Furthermore, sewing machines of the applicant are known the arm of which is upwards tiltable, i.e. about an axis, which is arranged in the sewing plane. Such sewing machines have workholders or carriers for a workpiece provided with areas of obstacles. Due to these areas of obstacles the clearance between the tip of the needle and the carrier for the workpiece is not sufficient to overcome such areas of obstacles when the needle is positioned in its upper dead center. Such sewing machines are provided with a drive connection of a 1 to 1 transmitting ratio between the armshaft pivoted in the arm and the hook driving shaft pivoted in the underarm. In order to keep the timing belt in a positive connection with the timing belt pulleys as the arm is tilted up, there are provided timing belt securing means. The maintaining of this positive connection between the timing belt and the timing belt pulleys is necessary in order to maintain the phase relation or the angular relation respectively between the armshaft and the hook driving shaft, which is essential for the stitch formation.

SUMMARY OF THE INVENTION

It is a main object of the invention to create a sewing head of the aforementioned type, which renders it possible to overcome also thicker areas of obstacles with the stud.

According to the invention the sewing head is provided with a means for downwards tilting said underarm including the tubular stud arranged on the latter and thus moving the stud out of the area of obstacles. The possibility to tilt downwards the total underarm including the tubular stud renders it possible to overcome projections as ribs or supporting arms arranged under the carrier for the workpiece. It is not necessary to additionally provide constructive measures in the sensitive and already constructively loaded area of the hook and the tubular stud. Moreover, the total underarm can remain completely unmodified in this area in comparison to a usual design. If the area of obstacle at the carrier for the workpiece extends not only versus the sewing plane but additionally upwards, the arm of the sewing head is made tiltable about an axle being provided in the area of the standard. If both, the upper arm and the underarm are tiltably arranged, it is advantageous to incorporate a common tilt axle because this renders possible that the drive connection between the armshaft and the hook drive shaft is situated in the underarm.

When said axle is arranged in a sewing plane spread out by said carrier for said workpiece, the tubular stud and occasionally the needle bar with the needle will be moved off the sewing plane from the start of the tilt motion of the underarm and occasionally of the arm.

Further inventive features allow to maintain a timing belt drive between the armshaft and the hook drive shaft even if the underarm and occasionally the upper arm are tiltably profiled.

Further objects, advantages and features of the present invention will appear from the detailed description of the preferred embodiment, which will now be explained in conjunction with the accompanying drawings.

DESCRIPTION OF THE PREFERRED EMBODIMENT

Figure 1:
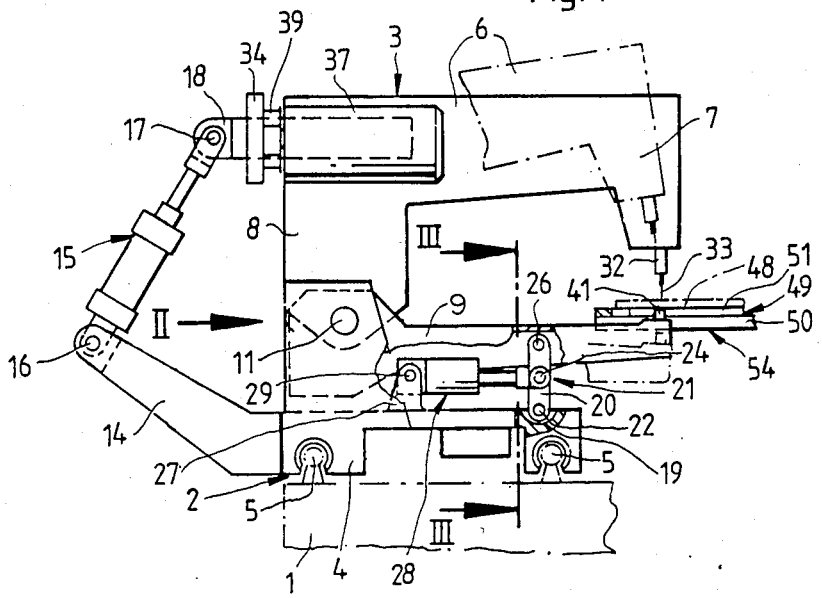
FIG. 1 is a sewing head according to the invention in a longitudinal projection.

On a machine stand 1 is arranged a supporting device 2 for a sewing head 3. The supporting device 2 consists of a carriage 4, which is horizontally displaceably arranged on guide rails 5 mounted on the machine stand 1.

The sewing head 3 is formed with an upper arm 6, which at one end terminates in a head 7 and at its other end in a standard 8. The arm 6 and the standard 8 are substantially rectangularly arranged to each other. Below the upper arm 6 an underarm 9 is provided.

On the carriage 4 is arranged a bearing block 10 in which on the one hand the standard 8 with the arm 6 and on the other hand the underarm 9 are tiltably pivoted about a common horizontal axle 11. For this purpose the standard 8 is formed at the area of its lower end with a bearing 12, through which extends the axle 11. Moreover, the underarm 9 has a U-shaped cross section in the area of the bearing block 10. Thus, the underarm 9 embraces with bearing webs 13 the bearing 12 of the standard 8 at both sides. Due to this arrangement the bearing webs 13 of the underarm 9 are received in the bearing block 10 as well as the bearing 12 of the standard 8.

At the carriage 4 a supporting arm 14 is situated, which extends backwards and upwards. Moreover, the supporting arm 14 extends in an imaginable vertical plane through the upper arm 6, the standard 8 and the underarm 9. An upper arm tilt drive denoted as a second tilt drive 15 is tiltably pivoted about a horizontal axle 16 to the free end of the supporting arm 14. The second tilt drive 15 is formed as a double-acting pneumatically operable piston cylinder drive the other end of which is pivoted about a horizontal axle 17 to a bearing arm 18. This bearing arm 18 is fastened at the end of the arm 6 in the area of the standard 8. If the second tilt drive 15 is actuated in such a way that it is shortened, the arm 6 is lifted upwards into a position as shown in dot-dashed lines in FIG. 1.

Figure 3:
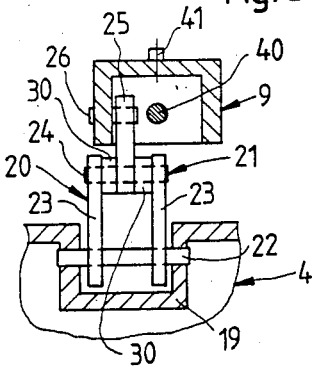
FIG. 3 is a cross section through the underarm of the sewing head according to section line III—III in FIG. 1.

The carriage 4 is provided with a tilt bearing 19 in the middle area of the underarm 9 or in the forward directed middle area of the underarm 9 with respect to the head 7 respectively. In this tilt bearing 19 a lever 20 of a toggle-lever-mechanism 21 is supported by means of a horizontal axle 22. According to FIG. 3 the lever 20 consists of two lever-shackles 23 extending in parallel to each other. The one ends of the lever-shackles 23 are pivoted on the axle 22, while their other ends are dispersed by a toggle-lever-axle 24, on which the other lever 25 of the toggle-lever-mechanism 21 is tiltably pivoted. As can be seen from FIG. 3 the lever 25 is positioned between the lever-shackles 23. The lever 25 is at its upper other end tiltably connected to the underarm 9 by means of an axle 26.

Between the levers 20 and 25 and the bearing block 10 the carriage 4 is formed with a bearing bracket 27, in which is pivoted an underarm-tilt-drive denoted as a first tilt drive 28. The latter is pivoted about an axle 29 and formed as a double-acting pneumatically operable piston cylinder drive. The other end of which is pivoted on the toggle-lever-axle 24 by means of a forked joint 30. In the stretched position as shown with completely drafted lines in FIG. 1, the axles 22, 24, 26 are positioned in a common vertical plane, i.e. the toggle-lever-mechanism 21 is stretched and thus supports the underarm 9 in its normal horizontal operating position, which is shown in FIG. 1 by completely drafted lines. If the second tilt drive 28 is pneumatically actuated in a sense of shortening, then the toggle-lever-axle 24 will be relocated towards the axle 29, i.e. the toggle-lever-mechanism 21 will be kinked-in, so that the underarm 9 will be tilted downwards into a position illustrated in FIG. 1 by dash-dotted lines.

In the upper arm 6 an armshaft 31 is pivoted, which terminates in the head 7. In the latter a vertically displaceable needle bar 32 with a needle 33 is pivoted, which is reciprocatingly driven by means of a usual crank drive (not illustrated). The armshaft 31 extending from the end of the upper arm 6 at the side of the standard 8 carries a handwheel 34 and a timing belt pulley 35 firmly secured thereon. The timing belt pulley 35 is drivingly connected to an off-drive wheel 36 formed also as a timing belt pulley. The latter is part of a sewing head drive 37. The timing belt 38, the drive wheel 36 and the timing belt pulley 35 form a timing belt drive 39 having a constant transmitting ratio.

Figure 2:
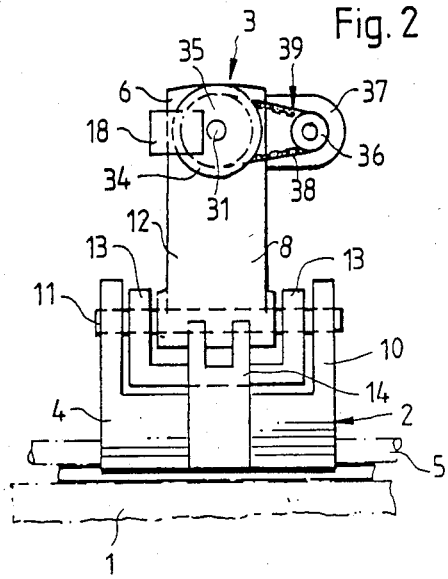
FIG. 2 is a front view of the sewing head according to arrow II in FIG. 1.
Figure 7:
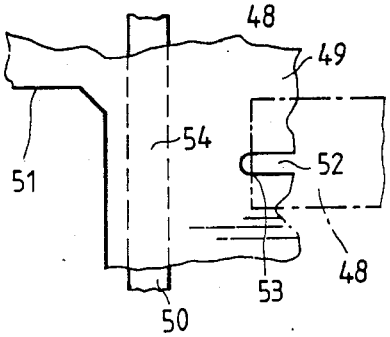
FIG. 7 is a partial top view onto a carrier for a workpiece with an area of obstacle for the underarm and the upper arm.
Figure 4:
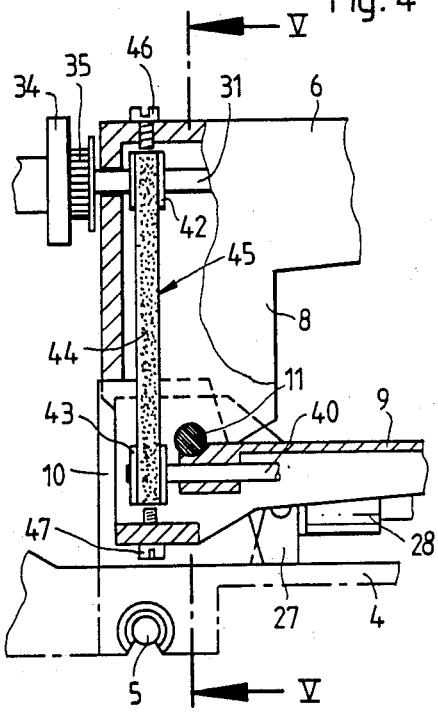
FIG. 4 is a partial longitudinal projection of the sewing head in a partially broken-open illustration.
Figure 6:
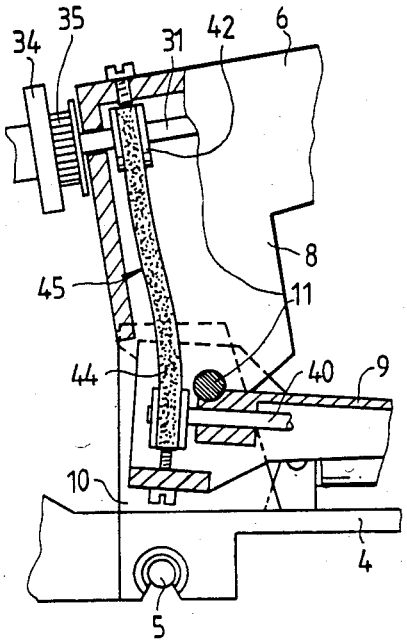
FIG. 6 is a partial longitudinal projection of the sewing head according to the illustration in FIG. 6 with tilted underarm and upper arm.
Figure 5:
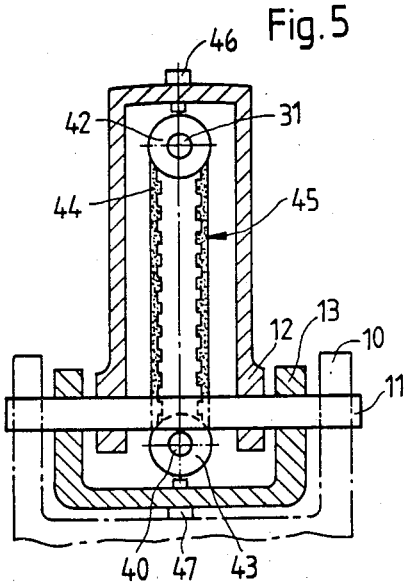
FIG. 5 is a section through the sewing head taken along section line V—V in FIG. 4.

The sewing head drive 37 is arranged at the upper outer side of the arm 6 as can be seen from FIG. 2.

A hook drive shaft 40 is pivotably received in the underarm 9, by which is driven a looptaker cooperating with the needle 33. The looptaker is located in the area of the free end of the underarm 9 and designed as usual and therefore not illustrated. Above the looptaker is shown a tubular stud 41, which is cylindrically profiled and situated on the underarm 9 in a usual manner. Into the tubular stud 41 immerses the needle 33 at the stitch formation. As obvious from FIG. 3 the hook drive shaft 40 is centrally arranged in the underarm 9, i.e. the toggle-lever-mechanism 21 is positioned laterally to the hook drive shaft 40 so that the mechanism 21 does not obstruct the hook drive shaft 40.

The armshaft 31 and the hook drive shaft 40 are arranged in a common vertical plane with respect to which the axle 11 extends perpendicularly. All other axles 11, 16, 17, 29, 26, 24, 22 are arranged in parallel to each other. On both shafts 31, 40 a first and a second timing belt pulley 42 and 43 are drivingly secured embraced by a timing belt 44. As both, the first and the second timing belt pulleys 42, 43 have equal diameters, the hook drive shaft 40 will be driven with the armshaft 31 at an equal RPM-rate. The first and the second timing belt pulley 42, 43 and the timing belt 44 form a hook drive means 45. The latter is situated behind the axle 11 as seen from the head 7 or the needle 33 and the tubular stud 41 respectively, so that the timing belt pulley 42 in the arm 6 will be swung downwards when the arm 6 is tilted upwards, i.e. the timing belt pulley 42 will be swung in the direction towards the timing belt pulley 43 of the underarm 9. On the other hand the second timing belt pulley 43 of the underarm 9 will be swung upwards when the underarm 9 is tilted downwards, i.e. towards the timing belt pulley 42 of the arm 6. As described the timing belt 44 will thus be loosened at the tilting of the upper arm 6 or the underarm 9 respectively, so that the tilt movements are not obstructed. In order to prevent a running-off of the timing belt 44 from the timing belt pulley 42 or 43 at the described tilt movements, there is situated a timing belt securing means 46 or 47 above the first timing belt pulley 42 and below the second timing belt pulley 43. The timing belt securing means 46 and 47 are designed in form of an adjustable screw. This can also be adjustably arranged at the upper arm 6 and the underarm 9 in order to adjust a clearance required for an unobstructed running of the timing belt 44.

A workpiece 48 to be sewn is supported by a carrier plate 49 horizontally and stationarily supported by support brackets 50. The latter are carried by the machine stand 1 in a manner not illustrated. In the carrier plate 49 there is a cutout 51, above of which the head 7 and below of which the free end of the underarm 9 with the tubular stud 41 are positioned as the sewing head 3 takes in its inoperative position of rest, in which sewing is not carried out.

In the carrier plate 49 a slot 52 is profiled which extends on the other side of the supporting bracket 50 seen from the side of the cutout 51. The slot 52 has a width, which corresponds approximately to the diameter of the cylindrical tubular stud 41 plus a little clearance of about 0.5 mm.

For sewing of the workpiece 48 positioned on the carrier plate 49 and above the slot 52, the second tilt drive 15 and the first tilt drive 28 are actuated as already described in such a manner that the upper arm 6 will be tilted into the upper position and the underarm 9 with the tubular stud 41 will be tilted into the lower position. The upper position of the head 7 and the lower position of the underarm 9 are illustrated by dash-dotted lines in FIG. 1.

Subsequently, the carriage 4 including the sewing head 3 will be driven to the left (according to FIG. 2) until the tubular stud 41 is positioned below the beginning of the slot 52. Then, due to an opposite actuation of the tilt drives 15 and 28, the upper arm 6 will be swung downwards and the underarm 9 upwards, so that the tubular stud 41 enters the slot 52. In this position the upper side of the tubular stud 41 flushes with the upper side of the carrier plate 49. Subsequently, a straight lined seam in parallel to the extension of the guide rails 5 can be generated due to a driving of the carriage 4 including the sewing head 3 on the guide rails 5. This can be accomplished without problems since the slot 52 also extends in parallel to the guide rails 5. Details of the carrier plate 49 carrying the workpiece 48 and the device for holding the workpiece 48 hereon can be derived from a patent application filed by the applicant at the filing date of this patent application having the title "Method for Sewing together a Tubular Workpiece and a Pocket-Shaped Workpiece and Automatic Sewing Device for Carrying out the Method" and claiming convention priority of German patent application ser. no. P 35 18 473.6. As becomes especially obvious from FIG. 1 the axle 11 extends in a plane presented by the upper side of the carrier plate 49, so that the needle bar 32 with the needle 33 on the one hand and the tubular stud 41 on the other hand will be directly tilted out of the sewing plane at the described tilting movements.

The area between the cutout 51 and the end 53 of the slot 52 directed towards the cutout 51, i.e. the closed area of the carrier plate 49 inclusive the support bracket 50 extending below the latter, is denoted as the area of obstacle. At the displacement of the sewing head 3 through this area of obstacle 54, the latter is to be overjumped by the arm 6 including the head 7 and is to be underpassed by the underarm 9 including the tubular stud 41.

What is claimed is:

1. Sewing head for a sewing machine with a supporting device for said sewing head; and with a carrier for a workpiece to be stitched, said sewing head and said carrier being displaceable relative to each other, said sewing head comprising:

a standard;

an upper arm and an underarm arranged at said standard; a drivable arm shaft pivoted in said upper arm; a needle bar with a needle reciprocatingly drivable by said armshaft; a tubular stud formed at said underarm and into which said needle immerses;

said sewing head having an inoperative position and a working position for stitching;

said sewing head being horizontally displaceable during the movement thereof from said inoperative position to said working position;

an area of obstacle to said tubular stud reached during horizontal displacement of said sewing head a device for downward tilting said underarm about an axle arranged in the area of said standard; and said device being for removing said tubular stud beyond said area of obstacle.

2. Sewing head according to claim 1, wherein an axle is provided in the area of said standard, about which said upper arm is additionally tiltable upwards out of said area of obstacle.

3. Sewing head according to claim 2, wherein said underarm and said upper arm are tiltable about a common axle.

4. Sewing head according to claim 1, wherein said axle is arranged in a sewing plane spread out by said carrier for said workpiece.

5. Sewing head according to claim 1, wherein a bearing is provided in said supporting device for receiving at least said underarm.

6. Sewing head according to claim 1, wherein a hook drive means is provided comprising:

a first timing belt pulley arranged on said armshaft;

a second timing belt pulley arranged on a hook drive shaft being pivoted in said underarm; and a timing belt drivingly connecting said first and said second timing belt pulley;

said hook drive means being arranged behind said axle seen from said needle and said tubular stud.

7. Sewing head according to claim 6, wherein timing belt securing means are associated to each of said timing belt pulleys.

8. Sewing head according to claim 1, wherein a first tilt drive for tilting said underarm is provided.

9. Sewing head according to claim 8, wherein a toggle-lever-mechanism is arranged between said underarm and said supporting device for said sewing head as to support said underarm, said first tilt drive being engaged with said toggle-lever-mechanism.

10. Sewing head according to claim 2, wherein a second tilt drive for tilting said upper arm is provided.

11. Sewing head according to claim 8, wherein a second tilt drive for tilting said arm is provided, each of said tilt drives being formed independently from one another.

12. Sewing head according to claim 11, wherein said tilt drives are pivoted to said supporting device.

* * * * *